US009689392B2

(12) United States Patent
Wickerath

(10) Patent No.: US 9,689,392 B2
(45) Date of Patent: Jun. 27, 2017

(54) MECHANICAL COOLANT PUMP

(75) Inventor: Bernd Wickerath, Moenchengladbach (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 365 days.

(21) Appl. No.: 14/373,631

(22) PCT Filed: Jul. 9, 2012

(86) PCT No.: PCT/EP2012/063435

§ 371 (c)(1),
(2), (4) Date: Jul. 22, 2014

(87) PCT Pub. No.: WO2013/120543

PCT Pub. Date: Aug. 22, 2013

(65) Prior Publication Data

US 2015/0093240 A1 Apr. 2, 2015

(30) Foreign Application Priority Data

Feb. 14, 2012 (WO) ..... PCT/EP2012/052525
May 31, 2012 (WO) ..... PCT/EP2012/060275

(51) Int. Cl.
*F04D 1/04* (2006.01)
*F04D 1/00* (2006.01)
(Continued)

(52) U.S. Cl.
CPC ..... *F04D 1/04* (2013.01); *F01P 5/10* (2013.01); *F01P 7/16* (2013.01); *F01P 11/00* (2013.01);
(Continued)

(58) Field of Classification Search
CPC ..... F04D 1/00; F04D 15/0005; F04D 15/022; F04D 29/46; F04D 29/466; F04D 29/468;
(Continued)

(56) References Cited

U.S. PATENT DOCUMENTS 4,709,666 A 12/1987 Merz
4,863,144 A 9/1989 Wilson et al.
(Continued)

FOREIGN PATENT DOCUMENTS

CN 102022174 A 4/2011
EP 2 299 084 A1 3/2011
(Continued)

*Primary Examiner* — Craig Kim
*Assistant Examiner* — Brian P Wolcott
(74) *Attorney, Agent, or Firm* — Norman B. Thot

(57) ABSTRACT

A mechanical coolant pump for an internal combustion engine includes a pump housing defining an outlet volute, a first outlet channel comprising a first valve opening, a second outlet channel comprising a second valve opening, an impeller pump wheel, and an outlet valve arrangement. The second outlet channel is separate from and fluidically parallel to the first outlet channel. The impeller pump wheel pumps a liquid into the outlet volute. The outlet valve arrangement is fluidically upstream of the first outlet channel and the second outlet channel. The outlet valve arrangement comprises an integral valve body which pivots between an open position and a closed position. The valve body comprises a first retaining section and a second retaining section. When the valve body is in the closed position, the first retaining section completely closes the first valve opening and the second retaining section only partially closes the second valve opening.

7 Claims, 5 Drawing Sheets

(51) Int. Cl.

| | |
|---|---|
| ***F04D 15/00*** | (2006.01) |
| ***F01P 5/10*** | (2006.01) |
| ***F01P 7/16*** | (2006.01) |
| ***F01P 11/00*** | (2006.01) |

(52) U.S. Cl.
CPC ..... *F04D 1/00* (2013.01); *F04D 15/0005* (2013.01); *F04D 15/0022* (2013.01)

(58) Field of Classification Search
CPC F01P 5/10; F01P 7/16; F01P 2007/146; F01P 11/00
USPC ..... 137/625.29, 625.46, 625.47
See application file for complete search history.

(56) References Cited

U.S. PATENT DOCUMENTS

| | | | | |
|---|---|---|---|---|
| 5,095,855 | A | 3/1992 | Fukuda et al. | |
| 2002/0179165 | A1 | 12/2002 | Hu et al. | |
| 2007/0235679 | A1* | 10/2007 | Sutliff et al. ..... | F16K 1/2007 251/317.01 |
| 2009/0183697 | A1 | 7/2009 | Inui | |
| 2012/0076637 | A1 | 3/2012 | Hoji | |
| 2012/0192816 | A1 | 8/2012 | Simon et al. | |
| 2013/0011250 | A1 | 1/2013 | Fournier et al. | |

FOREIGN PATENT DOCUMENTS

| | | | | |
|---|---|---|---|---|
| FR | 2 719 100 | A1 | 10/1995 | |
| JP | 48-104103 | A | 2/1972 | |
| JP | 58-81273 | A | 5/1983 | |
| JP | 61-52469 | A | 3/1986 | |
| JP | 3-222814 | A | 10/1991 | |
| JP | 4-237898 | A | 8/1992 | |
| JP | 10-77837 | A | 3/1998 | |
| JP | 11-2126 | A | 1/1999 | |
| JP | 2005-54997 | A | 3/2005 | |
| JP | 2007-303435 | A | 11/2007 | |
| JP | 2011-7055 | A | 1/2011 | |
| WO | WO 2010/146609 | A1 | 12/2010 | |
| WO | WO 2010/150379 | A1 | 12/2010 | |
| WO | WO 2011/095907 | A1 | 8/2011 | |
| WO | WO 2011/101019 | A1 | 8/2011 | |
| WO | WO 2011095907 | A1 * | 8/2011 | ..... F01P 5/12 |
| WO | WO 2011/154852 | A1 | 12/2011 | |

* cited by examiner

MECHANICAL COOLANT PUMP

CROSS REFERENCE TO PRIOR APPLICATIONS

This application is a U.S. National Phase application under 35 U.S.C. §371 of International Application No. PCT/EP2012/063435, filed on Jul. 9, 2012 and which claims benefit to International Patent Application No. PCT/EP2012/052525, filed on Feb. 14, 2012, and to International Patent Application No. PCT/EP2012/060275, filed on May 31, 2012. The International Application was published in English on Aug. 22, 2013 as WO 2013/120543 A1 under PCT Article 21(2).

FIELD

The present invention relates to a mechanical coolant pump for an internal combustion engine. A mechanical coolant pump is driven by the combustion engine, for example, by using a driving belt driving a driving wheel of the pump, so that the rotational speed of the coolant pump is proportional with the rotational speed of the combustion engine. Only a minimum coolant flow, if any, is needed as long as the combustion engine is cold. Mechanical coolant pumps can therefore be provided with an outlet valve arrangement for controlling the coolant flow leaving the coolant pump. As long as the combustion engine is cold, the outlet valve is closed so that the circulation of the lubricant is reduced, minimized or completely stopped, with the result that the combustion engine's warming-up phase is shortened and the energy consumption of the coolant pump is reduced.

BACKGROUND

WO 20011/101019 A1 describes an impeller-type mechanical coolant pump with an outlet valve arrangement in the root of an outlet channel. The coolant pump is provided with one single coolant outlet. The complete coolant delivery is stopped when the valve is closed so that neither the engine itself nor any other device of the engine, such as, for example, an exhaust gas recirculation cooler, is supplied with a coolant flow.

SUMMARY

An aspect of the present invention is to provide a mechanical coolant pump for an internal combustion engine with an outlet valve arrangement which allows the cooling of the engine to be stopped while continuing to cool an engine's device.

In an embodiment, the present invention provides a mechanical coolant pump for an internal combustion engine which includes an outlet volute, a pump housing defining the outlet volute, a first outlet channel comprising a first valve opening, a second outlet channel comprising a second valve opening, an impeller pump wheel, and an outlet valve arrangement. The second outlet channel is configured to be separate from and fluidically parallel to the first outlet channel. The impeller pump wheel is configured to pump an incoming liquid coolant in an axial direction radially into the outlet volute. The outlet valve arrangement is disposed fluidically upstream of each of the first outlet channel and the second outlet channel. The outlet valve arrangement comprises a valve body configured to be integral and to pivot between an open position and a closed position. The valve body comprises a first retaining section and a second retaining section. When the valve body is in the closed position, the first retaining section completely closes the first valve opening and the second retaining section only partially closes the second valve opening so that the second valve opening remains partially open.

BRIEF DESCRIPTION OF THE DRAWINGS

The present invention is described in greater detail below on the basis of embodiments and of the drawings in which.

DETAILED DESCRIPTION

Figure 1:
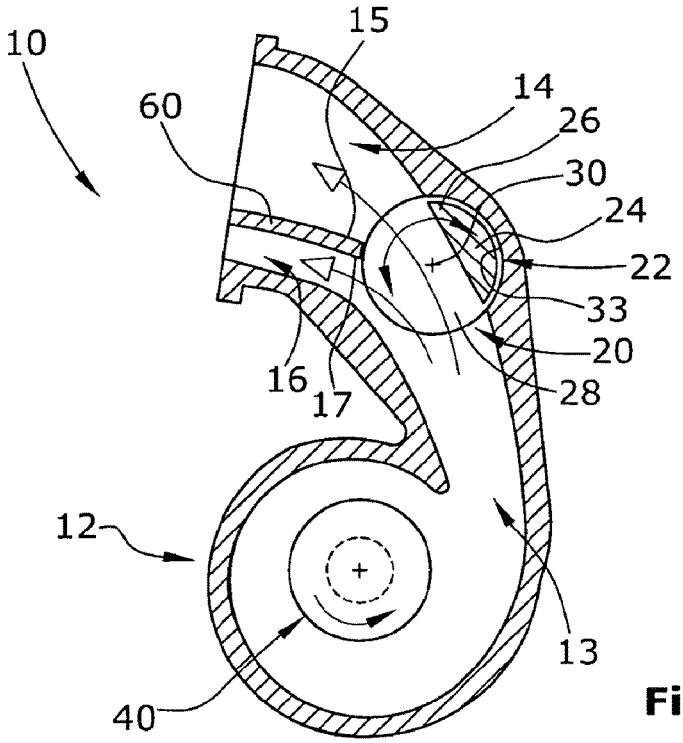
FIG. 1 shows a top view of a longitudinal section of a first embodiment of a mechanical coolant pump with a valve arrangement in the open position.

In an embodiment of the present invention, the mechanical coolant pump is provided with an impeller pump wheel pumping the liquid coolant incoming in the axial direction radially into an outlet volute. The outlet volute is defined by the pump housing which also defines two outlet channels, namely, a first outlet channel and a separate second outlet channel which is fluidically parallel to the first outlet channel. The first outlet channel can, for example, be provided for supplying the engine with the coolant. The second outlet channel can, for example, be provided for supplying an exhaust gas recirculation cooler with the coolant. An exhaust gas recirculation cooler warms up much faster than the engine itself after the engine has been started. Additionally, even in the engine's warming-up phase, the exhaust gas can become very hot so that the exhaust gas recirculation cooler requires cooling by the liquid coolant even if the engine itself has not reached its working temperature.

The mechanical coolant pump is provided with an outlet valve arrangement fluidically arranged before the first outlet channel and the second outlet channel. The valve arrangement is provided with a first valve opening of the first outlet channel and with a second valve opening of the second outlet channel. The valve openings can, for example, be arranged at the beginning of the respective outlet channel, but need not necessarily be arranged at the beginning of the respective outlet channel.

The outlet valve arrangement comprises an integral valve body with a first retaining section and a second retaining section. The valve body is provided so as to be pivotable between an open position and a closed position. In the closed position of the valve body, the first retaining section completely closes the first valve opening and the second retaining section only partially closes the second valve opening so that the second valve opening remains partially open.

The valve body is not necessarily made of one single piece, but can be an integral part comprising both retaining sections. When the valve body is in its open position, both retaining sections are in an open position so that both valve openings are completely open. In the closed valve body position, only the first outlet channel is completely closed. The coolant flow through the second valve opening into the second outlet channel would be increased significantly if only the first valve opening is closed with the second valve remaining completely open, which is not useful. By providing the second retaining section which covers the second valve opening only in part, but not completely, the coolant flow through the second valve opening into the second outlet channel can be adjusted more or less to the coolant flow through the second valve opening when the valve body is in its open position. The cooling control characteristics of the device which is supplied via the second outlet channel is therefore not significantly changed. The energy consumption of the coolant pump is additionally relatively low because less coolant is pumped by the coolant pump into the second outlet channel in the closed valve body position.

In an embodiment of the present invention, the valve body can, for example, be provided with a circular disk body at one axial end of the valve body. The valve body is pivotable around the center pivot axis of the circular disk body. The valve body can, for example, be provided with two circular disk bodies, one disk body at each axial end of the valve body. The valve body can, for example, have a geometry of a hollow cylindrical body, whereby the plane end walls are the circular disk bodies and parts of the cylinder define the two retaining sections. The proximal surface of the circular disk body is orientated substantially perpendicular to the general plane of the retaining sections.

In an embodiment of the present invention, the pump housing can, for example, be provided with a circular recess for recessing and embedding the corresponding circular disk body so that the proximal surface of the disk body and of the pump housing define a stepless surface with a low fluidic resistance.

In an embodiment of the present invention, the valve body pivot axis can, for example, be provided within the outlet volute, which is the fluidic channel just before the outlet valve arrangement. The proximal surfaces of the two retaining sections are distant from the pivot axis with an offset distance of minimally one fourth of the maximum outside radius of the cylinder embedding the valve body. The proximal retaining section surface is the surface which is facing the outlet volute in the open valve body position. The distal retaining section surface is the surface which is facing the corresponding outlet channel in the closed valve body position.

In an embodiment of the present invention, both retaining sections can, for example, define a circle segment of the cylinder defined by the circular disk body.

In an embodiment of the present invention, the pump housing can, for example, be provided with a recess for recessing at least one retaining section in the open valve position, and, for example, for housing at least the first retaining section. The second retaining section can, for example, also be housed in the recess in the open valve body position. By housing and recessing the retaining section in the recess, a more or less stepless surface in the corresponding volute wall is defined when the valve body is in its open position.

In an embodiment of the present invention, the second retaining section can, for example, be adjacent to the first retaining section so that both retaining sections define a single surface. The second retaining section can be arranged tangential to the first retaining body. The corresponding valve openings in this case are also arranged in tangential direction to each other.

The second retaining section can alternatively be arranged axially of the first retaining section. The corresponding valve openings are in this case also arranged and neighbored axially to each other.

Three embodiments of a mechanical coolant pump according to the present invention are hereinafter described under reference to the drawings.

FIGS. 1 to 7 show a mechanical coolant pump 10 for circulating a coolant in two separate parallel coolant circuits of an internal combustion engine. The first coolant circuit can be the engine block itself and the second coolant circuit can be a heat exchanger of another device related to the engine, for example, of an exhaust gas recirculation cooler, an oil cooler, an exhaust gas cooler etc. The coolant pump 10 is provided with a driving wheel 44 which can be driven by a driving belt which is directly driven by the internal combustion engine. The driving wheel 44 and the impeller pump wheel 40 are connected to each other by a rotor shaft 42. The rotational speed of the coolant pump 10 is proportional to the rotational speed of the internal combustion engine. The coolant pump 10 can be directly mounted to the engine block.

The coolant pump 10 is provided with a pump housing 12 housing an impeller pump wheel 40 pumping a liquid coolant incoming in axial direction radially into an outlet volute 13. Referring to FIGS. 1 to 6, the coolant inlet of the pump 10 is provided at the bottom side of the coolant pump 10.

The pump housing 12 defines two separate parallel outlet channels 14, 16 with a first valve opening 15 and a second valve opening 17 at the end of the outlet volute 13. The two outlet channels 14, 16 are separated from each other by a separation wall 60. The first outlet channel 14 is the main outlet channel and is, for example, connected with the engine block for cooling the engine block. The second outlet channel 16 is smaller in cross section than the first outlet channel 14 and is connected to a secondary cooling object, for example, to an exhaust gas recirculation cooler. In the area right before the valve openings 15, 17, an outlet valve arrangement is provided for controlling the coolant flow through the outlet channels 14, 16.

The outlet valve arrangement is provided with a single integral metal valve body 20 with a generally cylindrical basic geometry. The diameter of the valve body cylinder is greater than the width of the first valve opening 15 and can be even greater than the width of the volute opening right before the valve openings 15, 16. The end faces of the generally cylindrical valve body 20 are defined by two circular disk bodies 28, 32 which are completely recessed in corresponding circular recesses 29, 33 of the pump housing 12. The valve body 20 is pivoted around a pivot axis 30 which is the center axis of the cylinder and of the circular disk bodies 28, 32. The valve body 20 is actuated by a linear pneumatic actuator 38 via a lever arm 36 and a valve shaft 34 between an open valve position and a closed valve position.

The valve body 20 according to the first embodiment is provided with two integral retaining sections 24, 26 which are defined by one single circle segment 22 of the cylinder geometry defined by the circular disk bodies 28, 32. The two integral retaining sections 24, 26 are in the first embodiment arranged tangentially to each other, i.e., directly adjacent to each other in a circumferential direction of the cylinder geometry.

Figure 2:
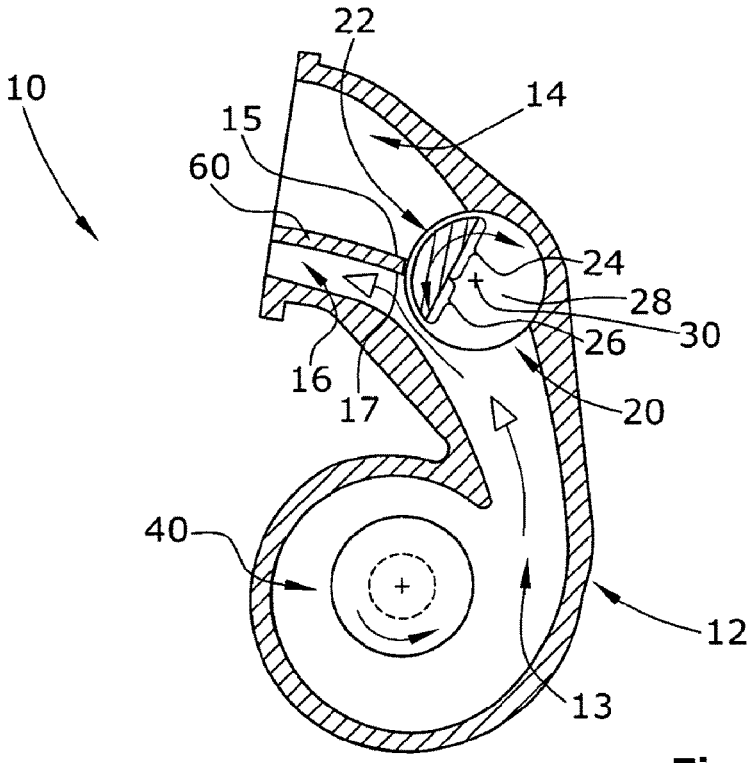
FIG. 2 shows the mechanical coolant pump of FIG. 1 with the valve arrangement in the closed position.
Figure 3:
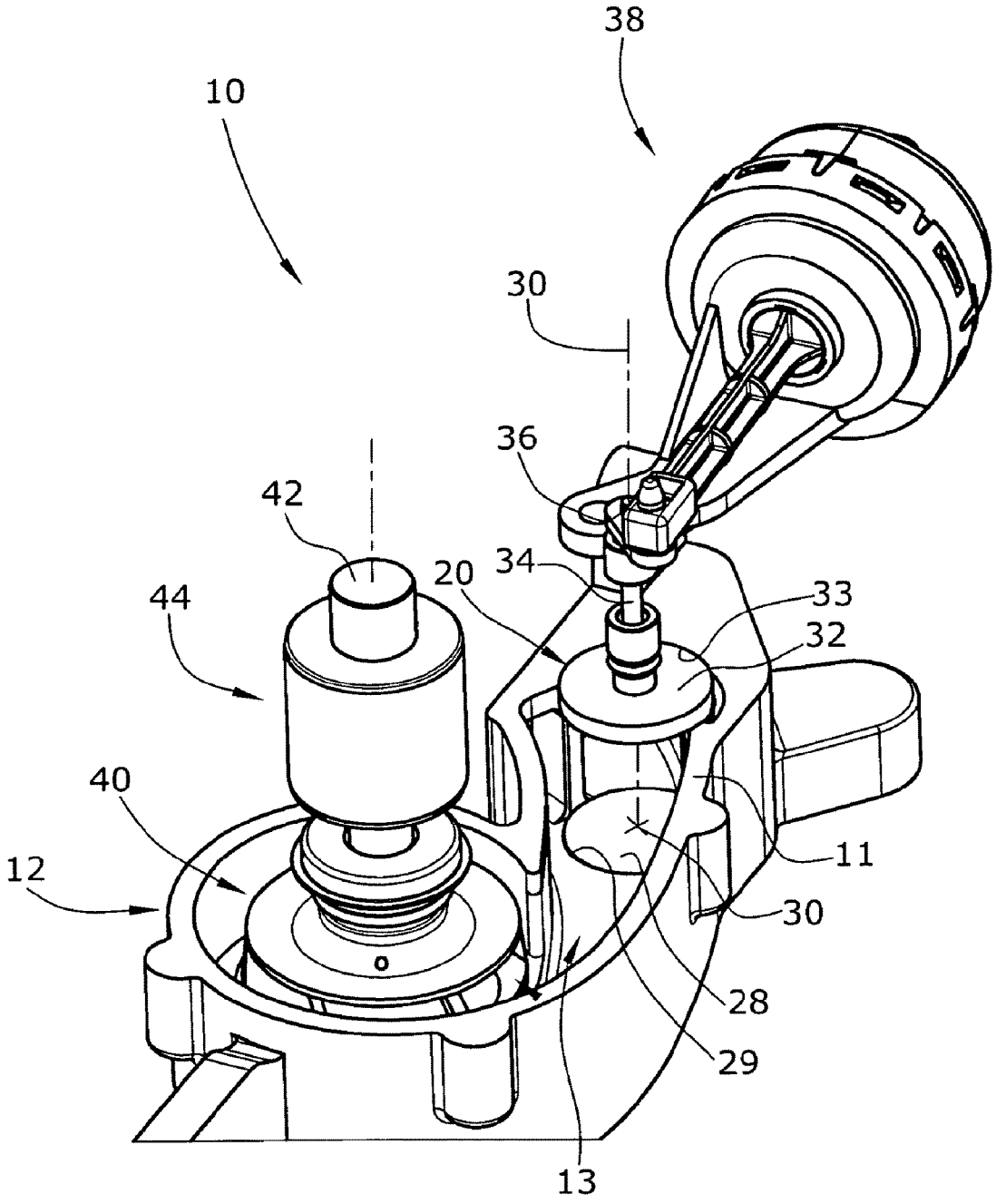
FIG. 3 shows a perspective view of the mechanical coolant pump without a pump housing cover and with the valve arrangement in the open position.
Figure 4:
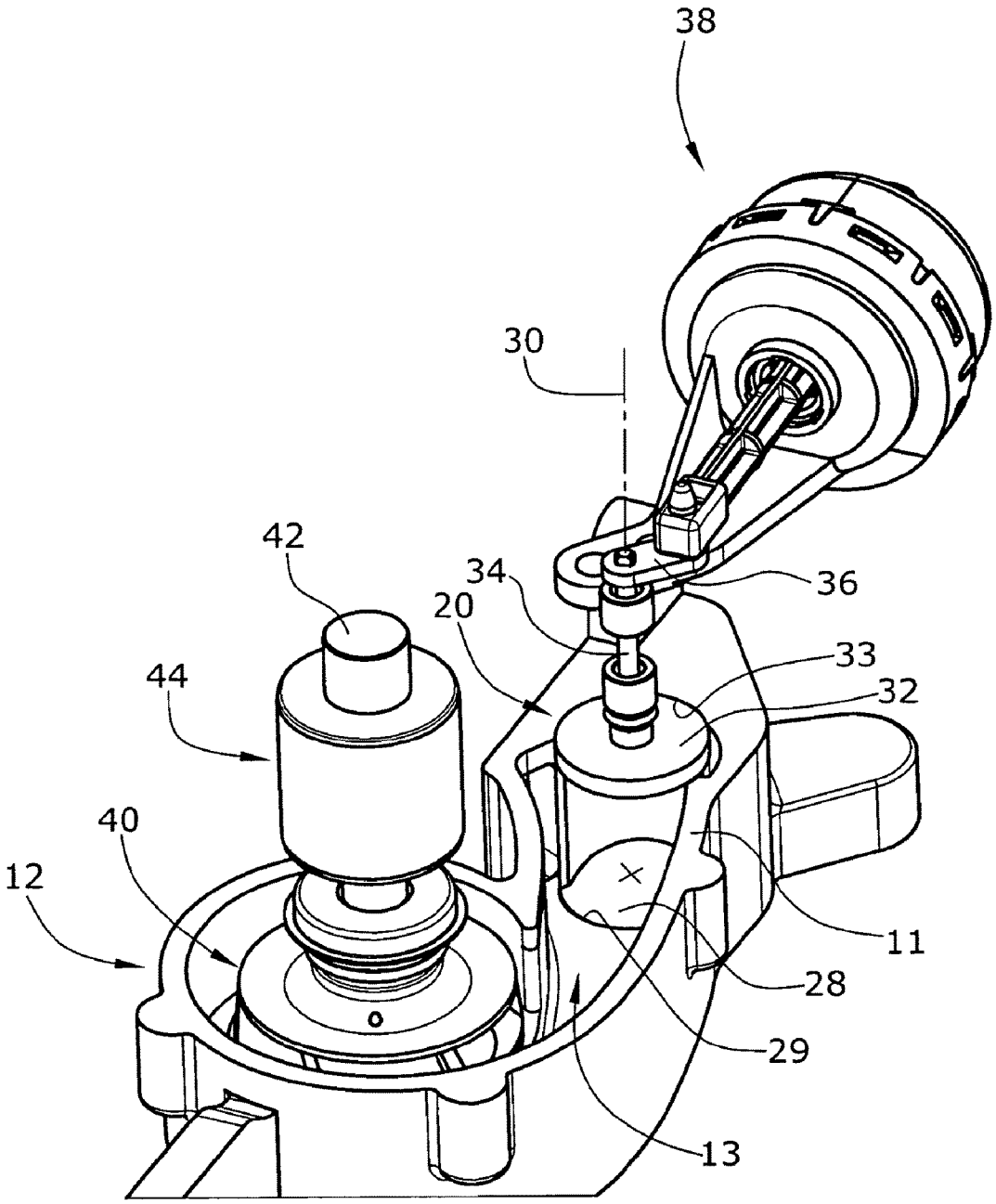
FIG. 4 shows the mechanical coolant pump of FIG. 3 with the valve arrangement in the closed position.

As shown in FIGS. 1 and 3, the circle segment 22 defining the two adjacent integral retaining sections 24, 26 is recessed in a corresponding recess 33 in a side wall 11 of the pump housing 12 in the open valve position so that a step-free sidewall is realized resulting in a low flow resistance. In the closed valve position which is shown in FIGS. 2 and 4, the valve body 20 has been pivoted by around 90° with respect to the open valve position so that the circle segment 22 defining the two adjacent integral retaining sections 24, 26 is positioned in the valve openings 15, 17 of the first and the second outlet channel 14, 16. The first retaining section 24 completely closes the first valve opening 15 of the first outlet channel 14. The second retaining section 26 does not close the second valve opening 17 completely, but covers between 40% to 80% of the opening area of the second valve opening 17. As a consequence, the valve body 20 completely closes the first outlet channel 14 and defines a throttle valve with respect to the second outlet channel 16. The coolant flow through the second outlet channel 16 therefore remains more or less constant independent of the valve body 20 being positioned in its open position as shown in FIG. 1 or its closed position as shown in FIG. 2.

Figure 5:
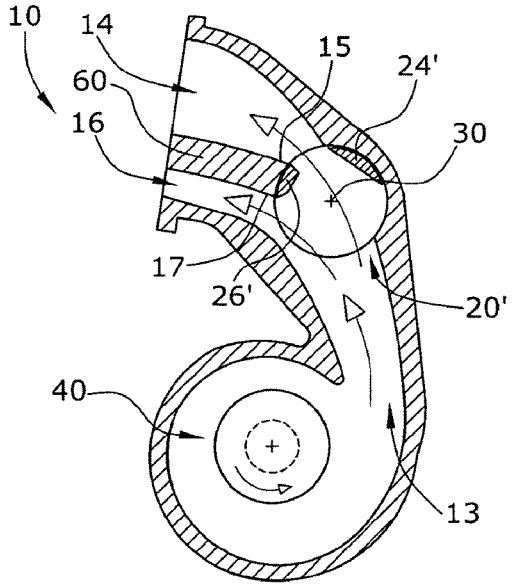
FIG. 5 shows a top view of a longitudinal section of a second embodiment of a mechanical coolant pump with a valve arrangement in the open position.
Figure 6:
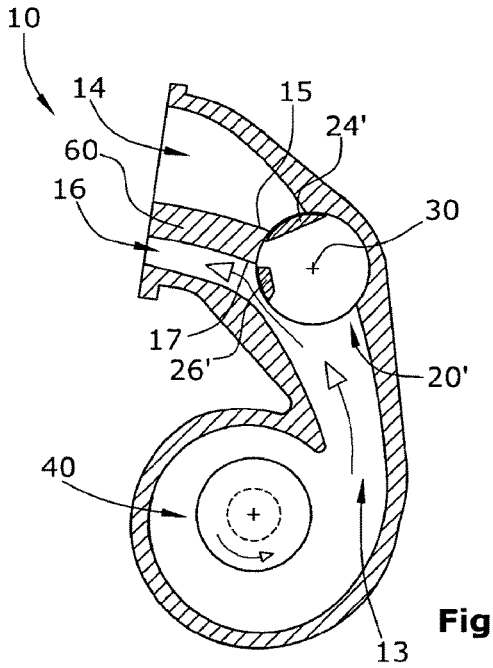
FIG. 6 shows the mechanical coolant pump of FIG. 5 with the valve arrangement in the closed position.

In the coolant pump 10 according to the second embodiment shown in FIGS. 5 and 6, the valve body 20' is provided with two retaining sections 24', 26' which are arranged separately and not directly adjacent to each other. The two retaining sections 24', 26' are, however, arranged tangentially to each other. In the open valve position shown in FIG. 5, the second retaining section 26' is positioned at the front end of the separation wall 60. When the valve body 20' is moving into its closed position, both valve openings 15, 17 are closed synchronously so that a coolant flow peak through the second outlet channel 16 can be avoided during the closing movement.

Figure 7:
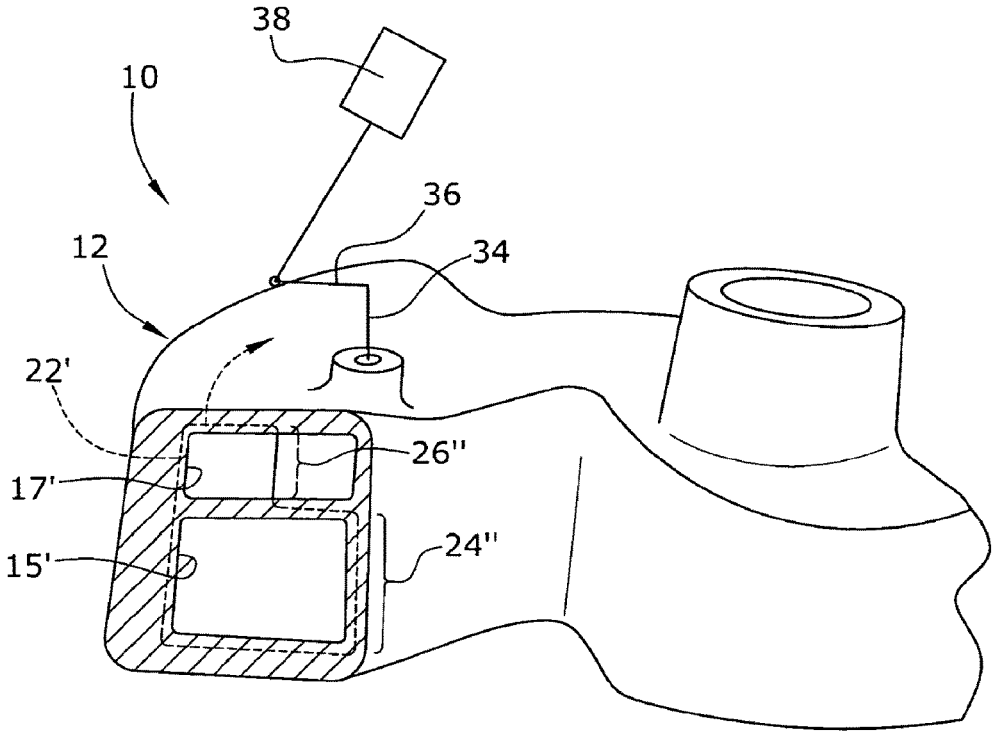
FIG. 7 shows a cross section of a third embodiment of a mechanical coolant pump with a valve arrangement in the closed valve position.

The coolant pump 10 according to the third embodiment shown in FIG. 7 is provided with another variation of the valve openings 15', 17' and the corresponding retaining sections 24", 26" of the valve body. In this embodiment, the pump valve openings 15', 17' as well as the corresponding retaining sections 24", 26" are arranged axially to each other so that the retaining sections 24", 26" define a single circle segment 22' and a synchronic opening and closing of both valve openings 15', 17' is realized.

The present invention is not limited to embodiments described herein; reference should be had to the appended claims.

What is claimed is:

1. A mechanical coolant pump for an internal combustion engine, the mechanical coolant pump comprising:

an outlet volute;

a pump housing defining the outlet volute;

a first outlet channel comprising a first valve opening;

a second outlet channel comprising a second valve opening, the second outlet channel being configured to be separate from and fluidically parallel to the first outlet channel;

an impeller pump wheel configured to pump an incoming liquid coolant in an axial direction radially into the outlet volute;

an outlet valve arrangement disposed fluidically upstream of each of the first outlet channel and the second outlet channel, the outlet valve arrangement comprising a valve body configured to be integral and to pivot between an open position and a closed position, the valve body comprising a first retaining section, a second retaining section, and a circular disk body which comprises a center pivot axis at an axial end of the valve body, the valve body being configured to pivot around the center pivot axis, wherein, when the valve body is in the closed position, the first retaining section completely closes the first valve opening and the second retaining section only partially closes the second valve opening so that the second valve opening remains partially open, and the circular disk body further comprises a circle segment defined by the first retaining section or by the first retaining section and the second retaining section.

2. The mechanical coolant pump as recited in claim 1, wherein the pump housing comprises a circular recess configured to recess the circular disk body.

3. The mechanical coolant pump as recited in claim 1, wherein the center pivot axis of the valve body is arranged within the outlet volute.

4. The mechanical coolant pump as recited in claim 1, wherein the pump housing comprises a recess configured to house at least one of the first retaining section and the second retaining section when the valve body is in the open valve position.

5. The mechanical coolant pump as recited in claim 1, wherein the second retaining section is arranged so as to be adjacent to the first retaining section so that the first retaining section and the second retaining sections define a single surface.

6. The mechanical coolant pump as recited in claim 1, wherein the second retaining section is arranged so as to be tangential to the first retaining section.

7. The mechanical coolant pump as recited in claim 1, wherein the second retaining section is arranged so as to be perpendicular to the first retaining section.

* * * * *